US006095930A

United States Patent [19]

Siddall

[11] Patent Number: 6,095,930

[45] Date of Patent: Aug. 1, 2000

[54] TRAINING AND ALIGNING ACCESSORY FOR ATTACHMENT TO A GOLF CLUB

[76] Inventor: John M. Siddall, 4620 Olivia Ave., Royal Oak, Mich. 48073

[21] Appl. No.: 08/914,623

[22] Filed: Aug. 19, 1997

Related U.S. Application Data

[63] Continuation of application No. 08/563,342, Nov. 28, 1995, abandoned.

[51] Int. Cl.[7] ..... A63B 69/36

[52] U.S. Cl. ..... 473/251; 473/240

[58] Field of Search ..... 473/238, 251, 473/252, 253, 254, 240

[56] References Cited

U.S. PATENT DOCUMENTS

| | | | |
|---|---|---|---|
| D. 233,535 | 11/1974 | Karban . | |
| D. 234,782 | 4/1975 | Creed . | |
| D. 245,438 | 8/1977 | Thiel . | |
| D. 245,439 | 8/1977 | Thiel . | |
| 1,327,171 | 1/1920 | Ruggles . | |
| 1,556,062 | 10/1925 | Baugh . | |
| 2,463,798 | 3/1949 | Paisley . | |
| 3,043,596 | 7/1962 | Ehmke . | |
| 3,170,698 | 2/1965 | Schoeffler et al. | 473/240 |
| 3,273,891 | 9/1966 | Grim, Jr. | 473/240 |
| 3,507,500 | 4/1970 | Scott . | |
| 3,700,244 | 10/1972 | Liotta . | |
| 3,727,920 | 4/1973 | Scott | 473/240 |
| 3,810,633 | 5/1974 | Scott, III . | |
| 4,002,343 | 1/1977 | Eckert | 473/251 |
| 4,116,448 | 9/1978 | Crowe, Jr. | 473/240 |
| 4,413,824 | 11/1983 | King et al. . | |
| 4,712,797 | 12/1987 | Kovalchek | 473/251 |
| 5,071,129 | 12/1991 | Wilson | 473/240 |
| 5,160,142 | 11/1992 | Marshall | 473/251 |
| 5,195,749 | 3/1993 | Ugarte . | |
| 5,213,331 | 5/1993 | Avanzini | 473/220 |
| 5,351,961 | 10/1994 | Eulau | 473/252 |
| 5,351,962 | 10/1994 | Lin | 473/251 |
| 5,478,078 | 12/1995 | Lee | 473/251 |

OTHER PUBLICATIONS

*Marketplace*, PUTTron advertisement (other particulars unknown) undated.

*Primary Examiner*—Raleigh W. Chiu

[57] ABSTRACT

A golf club aligning and training accessory for releasable attachment to a golf club head comprises a bracket releasably attachable to the golf club head, at least one cantilevered tab extending from the bracket for aligning the bracket with respect to the face of the golf club, an attachment component for releasably attaching the bracket to the golf club head, and a sighting component that allows the golfer to verify alignment of the golf club face with respect to a distant object substantially in front of the face, such as a golf flag. The accessory is attachable to the golf club either by adhesive attachment, magnetic attachment or by mechanical attachment of the tabs to the golf club face or by a collar assembly that is releasably positionable around the shaft of the golf club head.

21 Claims, 4 Drawing Sheets

TRAINING AND ALIGNING ACCESSORY FOR ATTACHMENT TO A GOLF CLUB

This is a continuation of U.S. patent application Ser. No. 08/563,342, filed Nov. 28, 1995 now abandoned.

BACKGROUND OF THE INVENTION

1. Technical Field

The present invention relates to training and aligning accessories for golf clubs. More particularly, the present invention relates to a training and aligning accessory for a golf club that includes an aligning mirror and a bracket for attaching the aligning mirror to the golf club.

2. Discussion

The game of golf typically requires a set of golf clubs, a bag for holding the clubs, golf balls, and a number of tees. One of the more difficult aspects of the game of golf is proper alignment of the club face of the golf club with the ball and target prior to the ball being struck by the golf club on the swing. This situation is true regardless of the type of club being used, but is particularly true with respect to the putter. The difficulty centers on the fact that the golf ball will generally go in the direction perpendicular to the face of the golf club. Accordingly, if the golf club face is slightly out of alignment with the desired direction of travel, the golf ball will go left or right of its mark. For example, the golfer standing on the putting green typically first assesses the condition of the green and the slope of the green between the golf ball and the cup. Once this assessment is made, the golfer prepares to drive the ball into the cup by use of the putter.

Two variables exist from this point forward. First, one is a question of power. If a golfer applies too much power, the ball, even though well directed, may pass the cup or may strike the edge of the cup and continue rolling. The second variable relates to the direction of travel of the hit golf ball. Again, because the golf ball travels perpendicularly with respect to the face of the club, if the face of the club itself is not aligned with the cup or target, the ball is likely to travel afield of the cup, that is, to the left or to the right of the cup, but not into the cup. Accordingly, it is desired to provide a tool that would be useful for training the golfer in proper alignment of the golf club face with respect to the cup or target.

In the past, several devices have been proposed that deal with the problem of providing an alignment tool for a golf club. It is not surprising that most of these tools have been directed to the golf club putter where the direction of travel is more critical than on the fairway, where the object is generally to achieve a controlled distance. These devices can generally be divided into two groups. One group includes golf clubs, particularly golf club heads, that have been modified to accept an alignment device which generally comprises a mirror. The other group, also relying upon a mirror as the alignment device, includes patents directed to accessories that may be attached to conventional golf club putters.

Exemplary patents of both types include: U.S. Pat. No. 1,327,171 issued on Jan. 6, 1920, to Ruggles; U.S. Pat. No. 1,556,062 issued on Oct. 6, 1925, to Baugh; U.S. Pat. No. 2,463,798 issued on Mar. 8, 1949, to Paisley; U.S. Pat. No. 3,043,596 issued on Jul. 10, 1962, to Ehmke; U.S. Pat. No. 3,273,891 issued on Sep. 20, 1966, to Grim, Jr.; U.S. Pat. No. 3,507,500 issued on Apr. 21, 1970, to Scott; U.S. Pat. No. 3,700,244 issued on Oct. 24, 1972, to Liotta; U.S. Pat. No. 3,810,633 issued on May 14, 1974, to Scott, III; U.S. Pat. No. 4,413,824 issued on Nov. 8, 1983, to King et al.; and U.S. Pat. No. 5,195,749 issued on Mar. 23, 1993, to Ugarde.

While addressing many of the concerns regarding the provision of a tool for properly aligning the golf club face with respect to the cup on the putting green, the devices that permanently incorporate a sighting device fail to provide a satisfactory answer because of the need to provide a specifically designed and formed golf club head for this purpose. This approach is expensive, and limits the golfer's choice to the weight and feel of the club as dictated by the manufacturer. Because the aligning tool should be an accessory that may be removed from the golf club, it would be undesirable for the golfer to have a putter that includes this equipment permanently, elsewise the golfer will have to carry two putters in his golf bag, one an aligning putter and the other a conventional putter. This is not a practical solution to the problem. In addition, all of these patents provide for a golf club alignment device that is permanently formed as part of a golf club putter alone. This situation does not answer the need for such an alignment device that may be transferred to other golf clubs in the golfer's arsenal.

In an apparent effort to overcome the need to provide a permanently modified golf club putter, some devices have been provided which are accessories that may be attached to golf club putters and may be releasably removed thereafter. One such example of these devices is U.S. Pat. No. 3,810,633, issued to Scott III, on May 14, 1974, for "Golf Putter Sighting Device (hereinafter referred to as "Scott III"). This invention teaches an accessory that includes a spring-loaded mounting element for resilient attachment of the accessory to the golf club putting head.

While providing an accessory that is usable on a golf club and then may be removed so that the golfer can selectively use the putter without having to encumber the club with the accessory, the device of Scott III, provides a "wraparound" housing that restricts use of the putter accessory to those putters that have a flat back that is substantially perpendicular to the golf club face. Today's golf club putter technologies typically do not utilize only a putter with a flat back, and very frequently include rounded or otherwise curved backs for weight advantages during the putting game. Furthermore, the device of Scott III, also fails to provide a practical method for attaching such an accessory to a golf club other than the putter, as neither the backs of the conventional iron nor the conventional wood are flat and parallel with the golf club face. In addition, the device of Scott III, includes a bottom portion 18 which interferes with the use of the club by positioning the golf club head off of the green. This alters the player's sense for the position of the club.

Accordingly, known modified golf club heads and known accessories for attachment to golf clubs have failed to provide a solution to the problem of the need for an aligning and training device for use in association with a golf club.

BRIEF DESCRIPTION OF THE INVENTION

It is accordingly an object of the present invention to provide a golf club aligning and training accessory that is releasably attachable to a putter.

It is a further object of the present invention to provide a golf club aligning and training accessory that is releasably attachable to golf clubs other than the putter, such as the iron and the driver.

Yet a further object of the present invention is to provide a golf club aligning and training accessory which does not rely on a "wraparound" construction for attachment of the accessory to the golf club head.

Yet a further object of the present invention is to provide a golf club aligning and training accessory that includes a flush surface that contacts the golf club face for alignment therewith.

Still a further object of the present invention is to provide a golf club aligning and training accessory that in one embodiment may be releasably attached to the golf club face by a magnet.

An additional object of the golf club aligning and training accessory according to the present invention is to provide a metal plate or metallic tape that may be attached to the golf club face for those golf clubs that do not provide a surface attractive to magnetic forces.

A further object of the golf club aligning and training accessory according to the present invention is to provide a pair of slots on the golf club face for releasably receiving the tabs of the accessory.

An additional object of the present invention is to provide a golf club aligning and training accessory that includes a slot through which the golfer views the notch found on the top of the golf club head when the club head lies properly on the ground.

Yet an additional object of the present invention is to provide a golf club aligning and training accessory that includes as an alternate method of attachment a collar that may be releasably attached to the hosel of the golf club shaft.

Yet a further object of the present invention is to provide a golf club aligning and training accessory that includes as an additional method of attachment a suction cup that may be attached to the golf club face or to a metal plate or to metallic tape fitted to the golf club face.

Still a further object of the golf club aligning and training accessory of the present invention is to provide such an accessory that employs a mirrored surface for visualizing the cup on the putting green by the user.

Yet a further object of the golf club aligning and training accessory is to incorporate into such an accessory a laser light aligning device that reflects against the pole of the flag in the cup when the golf club face is properly aligned with respect to the flag.

These and other objects of the present invention are achieved by providing an accessory for releasable attachment to a putter or other golf club. The accessory incorporates a bracket having an image-sighting support structure having one or more aligning tabs for placement against the face of the golf club, and an assembly for attaching the assembly to the golf club head.

According to the preferred embodiment of the present invention, the image-sighting element is a diagonal mirror. The mirror may be flat or may be convex. In either embodiment, the mirror is permanently attached to the support structure of the bracket. The flat mirror may be preferred for delivering to the observer an accurate reflected image, while the convex mirror may be preferred for delivering to the user a wider image of the field in front of him.

In either embodiment of the mirror, an alignment line is marked on the mirror face which is visualized by the user and suggests to the user that when the flag is in alignment with the alignment line, the golf club face is properly perpendicularly aligned with the cup on the green. In addition, the bracket includes a notch that is formed between the mirrored surface and the center mark conventionally provided on the top of the golf club head.

When the observer is using the golf club with the accessory attached thereto, the user will observe the mark conventionally provided on the top of the golf club head within the notch formed on the bracket. This tells the user that the golfer's eyes are perpendicular to the mirror and that the image viewed in the center line is the true ball direction. This can be viewed by rocking the base of the club to adjust the club's lie on the ground.

An alternative embodiment of the image-sighting device is a small laser-light emitting unit which, when properly aligned with the flag, will reflect a small mark of laser-emitted light on one side of the pole of the flag. As a further option, the laser-light emitting unit may be used in conjunction with the mirror to provide the user with not only an emitted light on the flag pole, but also with means of visualizing the emitted light.

The present invention also provides two alternative methods for releasably attaching the accessory to the golf club head. The first of these is to utilize the aligning tabs as the attachment assemblies. This can be done a number of ways. The preferred method is to incorporate a magnetic material on the tabs which therefore releasably and easily attaches itself to the golf club face. For those clubs that are produced from a non-ferrous material, one or more metal strips having an adhesive backing may be provided for releasably attaching the magnetized tabs thereto. Alternative methods of attaching the tab or tabs to the golf club face include two-sided and hook-and-loop fasteners (Velcro®), suction cups, or slots.

As an alternative to attaching the accessory directly to the golf club face, the tabs on the aligning and training accessory are only used for aligning the accessory on the golf club face, while a collar is provided in association with the bracket of the accessory for releasably attaching the accessory to the hosel of the golf club shaft.

Because the aligning and training accessory of the present invention is releasably attachable, the golfer may keep the accessory in the golf bag. When the golfer desires to use the accessory, the accessory is simply removed from the bag and is attached to the golf club face or the hosel, as the embodiment may dictate.

The accessory of the present invention can be used in one of two ways. First, the golfer may use it as an aligning device whereby the golfer can verify that proper alignment of the club face with respect to the flag has been made by viewing the image in the mirror. Optionally, the accessory of the present invention can be used as a training device whereby the golfer aligns the club without relying on the mirror and then, once the alignment of the club is made, the golfer can verify that the alignment has been correctly made by relying on the mirror to visualize the position of the flag with respect to the golf club face. Depending upon the method of attachment, the device of the present invention may be temporarily used for practice and training (generally in the case of woods and irons) or may be left on for play (generally in the case of putters).

Other advantages and features of the present invention will become more apparent as the description of the present invention proceeds.

BRIEF DESCRIPTION OF THE DRAWINGS

The present invention will be more fully understood by reference to the following detailed description of the preferred embodiments of the present invention when read in conjunction with the accompanying drawings in which like reference characters refer to like parts throughout the views, and in which.

DETAILED DESCRIPTION OF THE PREFERRED EMBODIMENT

The drawings disclose the preferred embodiments of the present invention. While the configurations according to the illustrated embodiments are preferred, it is envisioned that alternate configurations of the present invention may be adopted without deviating from the invention as portrayed. The preferred embodiment is discussed hereafter.

The present invention generally relates to a training and aligning accessory for removable attachment to a golf club head. The accessory generally includes an aligning mirror and a bracket for attaching the aligning mirror to the golf club. A variety of methods of attaching the aligning portion to the golf club are set forth.

Figure 1:
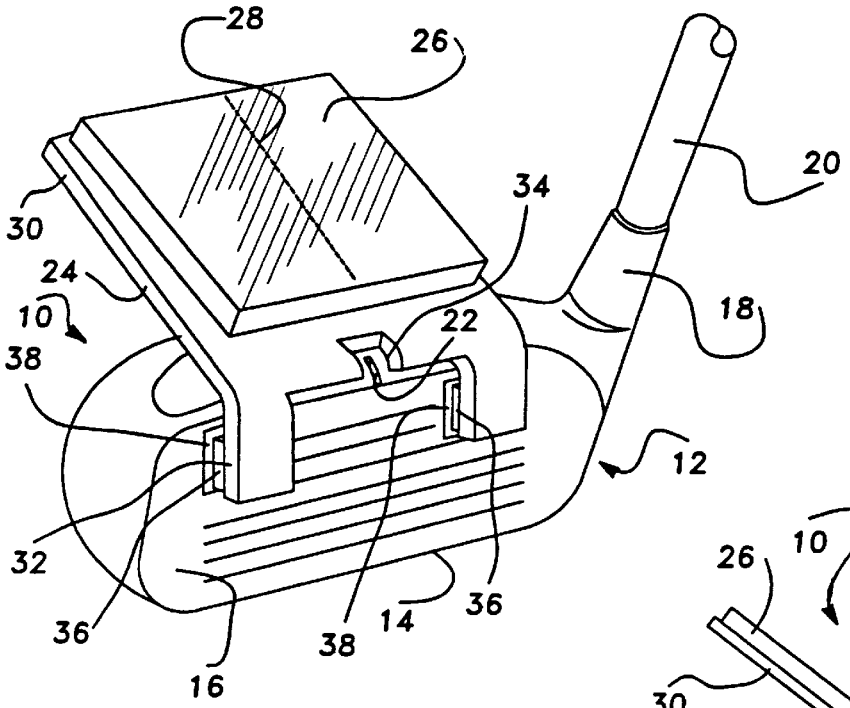
FIG. 1 is a perspective view of a golf club head and part of the shaft having the preferred embodiment of the training and aligning accessory of the present invention attached thereto.
Figure 2:
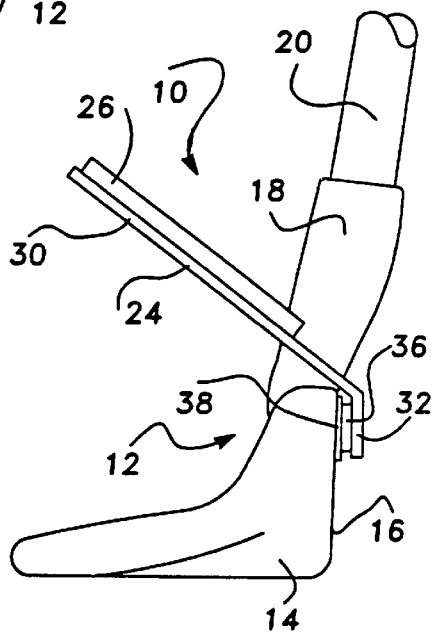
FIG. 2 is an end view of the golf club head and the device as illustrated in FIG. 1.

With respect to FIGS. 1 and 2, a perspective view and an end view are respectively shown of an accessory, generally illustrated as 10, which is attached to a golf club, generally illustrated as 12. The golf club 12 includes a golf club head 14 having a substantially flat golf club face 16, a hosel 18, and, shown in part, a golf club shaft 20. An alignment mark or notch 22 is typically provided on the golf club head 14. The golfer relies upon the mark 22 for centering the golf ball (not shown).

The illustrated accessory 10 is a preferred embodiment of the present invention, but variations (discussed below with respect to FIGS. 3 through 6) are possible. The accessory 10 includes a bracket 24 and a highly polished surface such as a metal plate (such as stainless steel) or an aligning mirror 26. (While not shown, the accessory 10 may be formed from a single piece of metal, with at least the mirror being highly polished.) The bracket 24 may be composed of a metal (in, for example, a stamped, molded, or wire form) or of a plastic. The mirror 26 is attached to the bracket 24 by chemical or mechanical fastening and may be a flat mirror as illustrated or may be a convex mirror (not shown). The flat mirror produces a "true" representative image, while the convex mirror produces a condensed representative image and may be used for expanding the user's reflected field of view.

In either embodiment of the mirror 26, a centerline 28 is provided either on the mirror 26 by marking, taping, or etching or within the mirror 26 by either being embedded in the glass or formed on the silver mirror backing. Additionally, the centerline 28 may be formed from a rigid or flexible member such as a wire, elastic band, or a string. The centerline 28 is used by the golfer to align the ball with the cup or the flagpole. Both the ball and the flagpole appear in the mirror when the club is held by the user while addressing the golf ball. The mirror 26 may be formed from a glass plate having a silver mirror backing or may be a highly polished material such as steel.

The bracket 24 includes a mirror support 30 and a pair of spaced apart tabs 32. The tabs 32 are spaced apart to define a space therebetween on the face 16 as illustrated against which the ball (not shown) makes contact. A notch 34 is formed on the mirror support 30. This notch 34 allows the user to observe the mark 22 to thereby align the centerline 28 of the mirror 26, and to ensure that his eyes are perpendicular to the mirror 26.

One of the novel features of the present invention is the method by which the accessory 10 is attached to the golf club 12. The embodiment shown in FIGS. 1 and 2 is attached by a pair of magnets 36 fitted to the inner sides of the tabs 32. This method of attachment allows the accessory 10 to be mounted on and removed from the golf club head 14 with relative ease. Because many golf club heads are formed from a non-ferrous material, a pair of mounting plates 38 are optionally provided and are attached to the golf club face 16 by means such as two-sided adhesive tape or adhesive cement. The mounting plates 38 may be solid strips of metal or may be metallic tape. An alternative method of attaching the tabs 32 to the golf club face 16 which is similar to that illustrated in FIGS. 1 and 2 is to provide hook-and-loop fasteners between the tabs 32 and the face 16. This embodiment is not shown, but would be readily understood by those skilled in this art.

In operation, the user attaches the accessory 10 to the golf club face 16 before using the club. The accessory 10 may thereafter be left on the club or may be removed after training and aligning.

Figure 3:
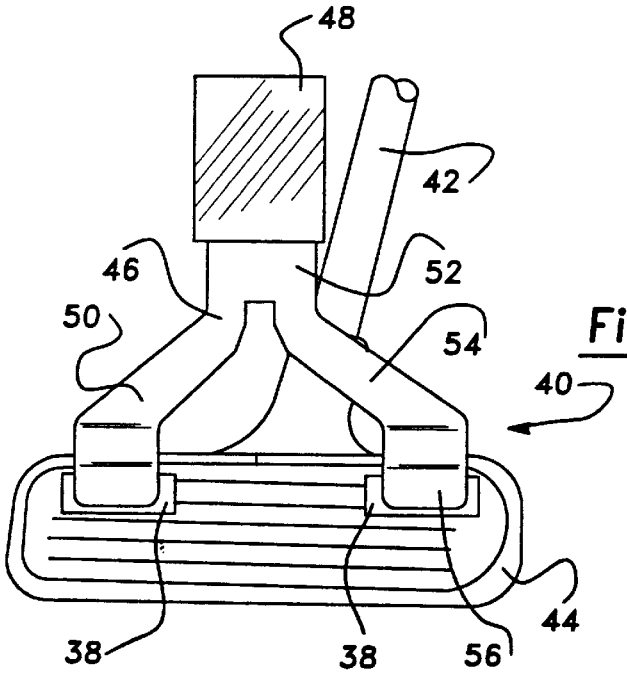
FIG. 3 is a view of a golf club face having an alternate embodiment of the training and aligning accessory of the present invention attached thereto.
Figure 4:
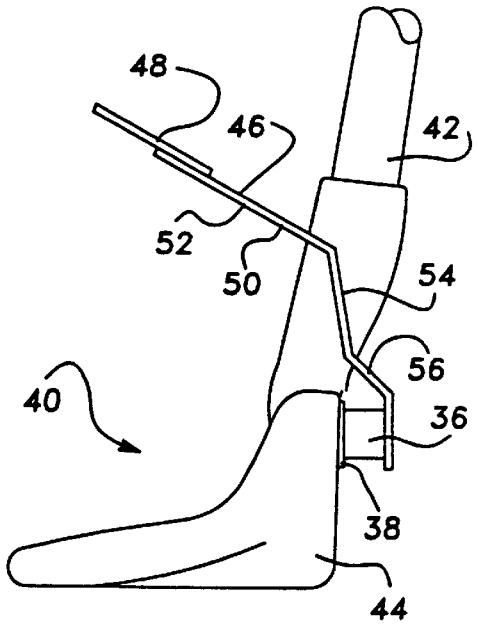
FIG. 4 is an end view of the golf club head and the device as illustrated in FIG. 3.

As shown in FIGS. 1 and 2, the golf club shaft 20 is positioned at the end of the golf club 12, thus providing room for the mirror 26. However, not all golf clubs have this construction, and may instead have a base of the shaft that is positioned more toward the center of the golf club head. FIGS. 3 and 4 demonstrate such a club, generally illustrated as 40 which includes a shaft 42 and a golf club head 44. Such a club would not permit positioning of the accessory 10 thereupon. Accordingly, a modified accessory 46 is provided which includes a relatively narrow mirror 48 that is mounted on a frame 50. The frame 50 includes a narrow neck 52 which is joined to a pair of spaced apart legs 54 which terminate at a pair of spaced apart tabs 56. The tabs 56 are attached to the club head 44 by any of the methods discussed herein. As illustrated, the tabs 56 are attached by the magnets 36 which are themselves attached to the club head 44 by the pair of mounting plates 38.

Figure 5:
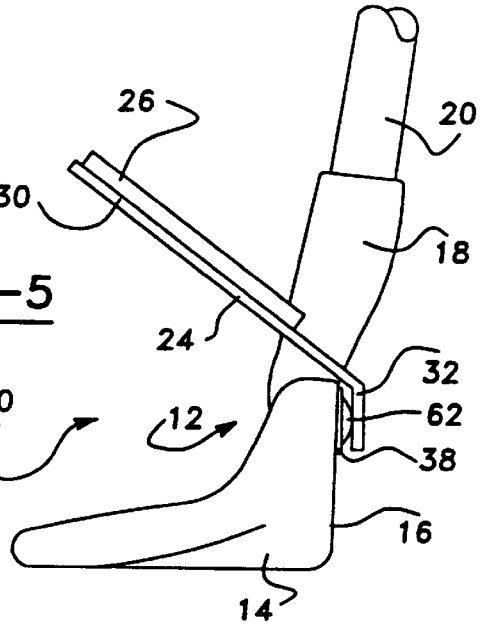
FIG. 5 is an end view of the golf club head illustrating an alternative method of attaching the device of the present invention to the golf club head.

An alternate method of attaching the accessory of the present invention is illustrated in FIG. 5 which illustrates an end view of an accessory, generally illustrated as 60, mounted to the golf club 12. More particularly, the accessory 60 includes the bracket 24 and the aligning mirror 26. The mirror 26 is constructed substantially as set forth above with respect to FIGS. 1 and 2. The bracket 24 includes the mirror support 30 and the pair of spaced apart tabs 32. Again, the mirror support 30 and the pair of spaced apart tabs 32 are substantially the same as those described and discussed above with respect to FIGS. 1 and 2.

The accessory 60 is attached to the golf club face 16 by a pair of suction cups 62 that are attached to the tabs 32. In the event that the surface of the golf club face 16 is irregular and not capable of forming a seal with the suction cups 62 such that an area of reduced air pressure may be created between the suction cups 62 and the face 16, the pair of mounting plates 38 are fitted to the golf club face 16 by means described above such as adhesive tape or adhesive cement. In addition, because the metallic qualities of the plates 38 are not necessary for proper adhesion of the suction cups 62, tape (such as clear tape) may be alternatively employed. As with the accessory 10 described above with respect to FIGS. 1 and 2, the accessory 60 may be left on the golf club 12 during play or may be removed after training or alignment are completed.

Figure 6:
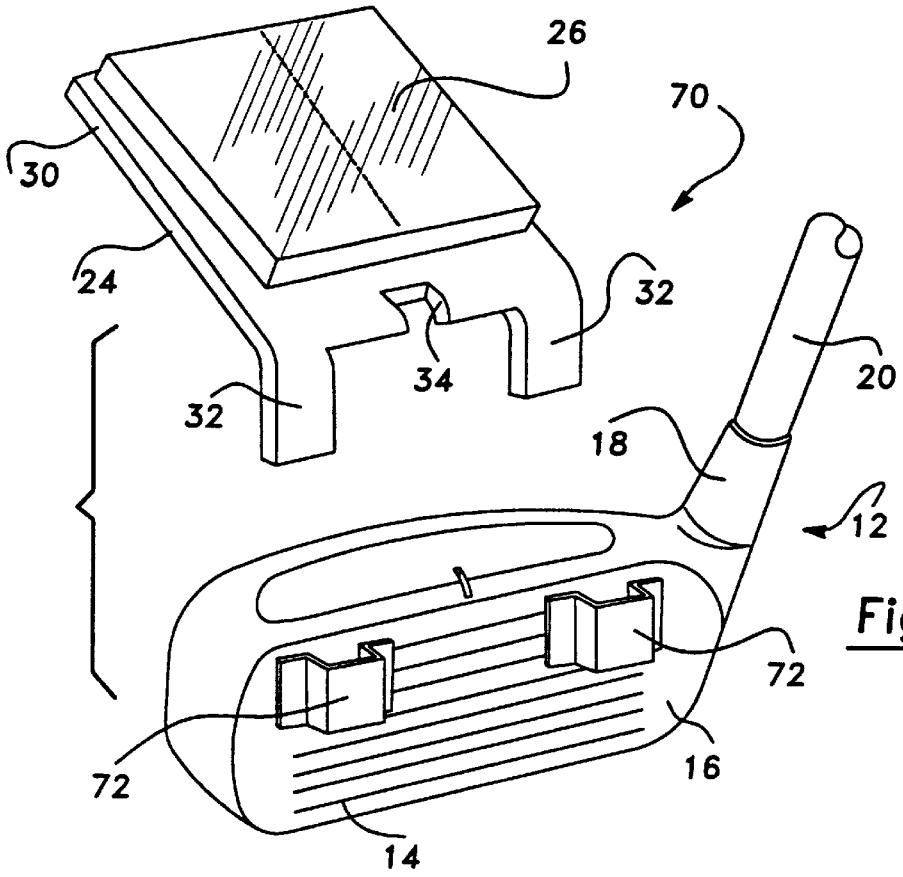
FIG. 6 is a view of an alternative embodiment of the device of the present invention shown in spaced-apart relation from the golf club head.

FIG. 6 illustrates a perspective view of the golf club 12 and an accessory 70. As with the accessory 60 of FIG. 5, the accessory 70 is substantially the same as the accessory 10 of FIGS. 1 and 2 but differs only in the method of attaching the accessory to the golf club 12. Accordingly, the accessory 70 includes the bracket 24 and the aligning mirror 26. The bracket 24 also includes the mirror support 30 and the pair of spaced apart tabs 32. The notch 34 is also shown in this figure as it is in FIG. 1.

In lieu of either a magnet or a suction cup attached to the tabs 32, the tabs 32 are removably insertable into a spaced apart pair of slots 72. The slots 72 are attached to the golf club face 16 by known means such as magnets or, in case the golf club head 14 is formed from a non-ferrous material, adhesive tape, adhesive cement, or suction cups. The tabs 32 are inserted into the slots 72 when the golfer wants to use the accessory 70 and provide for easy removal of the accessory 70 when the golfer desires not to rely on the device.

It may be desired for the angle of the mirror face to be adjusted with respect to the golf club face. This is partially true where the golfer moves the aligning and training device of the present invention from a putter to a driver or from one iron to another iron. Because the angles of the golf club faces change from club to club, the aligning and training device of the present invention would likewise have to change.

Figure 7:
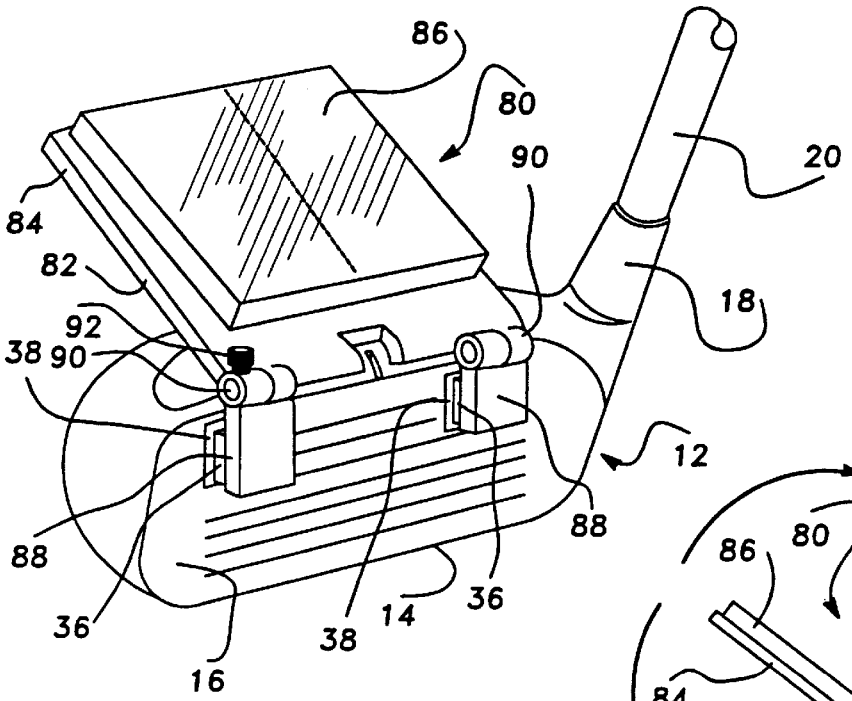
FIG. 7 is a perspective view of the golf club head of FIG. 1 having a further alternate embodiment of the training and aligning accessory of the present invention attached thereto.
Figure 8:
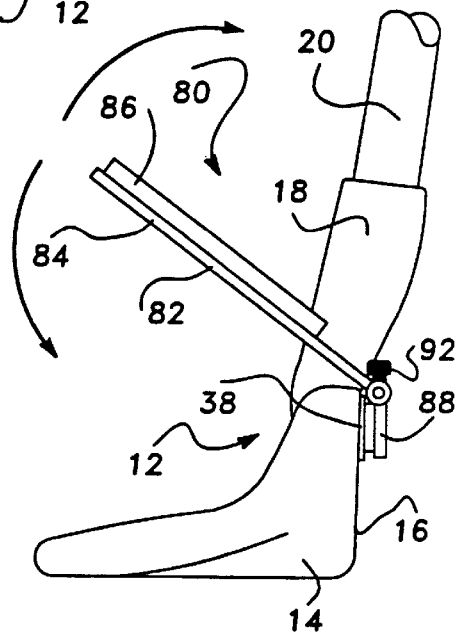
FIG. 8 is an end view of the golf club head and the device as illustrated in FIG. 7.

Accordingly, an adjustable aligning and training accessory, generally illustrated as 80, is shown in FIGS. 7 and 8. The accessory 80 includes a bracket 82. The bracket 82 includes a mirror support 84 having an aligning mirror 86 attached thereto. A pair of spaced apart tabs 88 are hingedly attached to the mirror support 84 by a pair of hinges 90. A hinge stop knob 92 is optionally provided to freeze movement of the tabs 88 with respect to the mirror once the preferred angle is set. Optionally, the hinges 90 may be constructed so as to resist movement of the mirror support 84 with respect to the tabs 88.

As a further modification to the present invention, a compound mirror assembly may be utilized to alter the displacement of the training and aligning device of the present invention. For example, the golfer may desire to have an image of the cup or target that is higher off the ground than that of the previously discussed accessories 10, 60, 70 or 80. This is particularly true in areas having intervening rough terrain.

Figure 9:
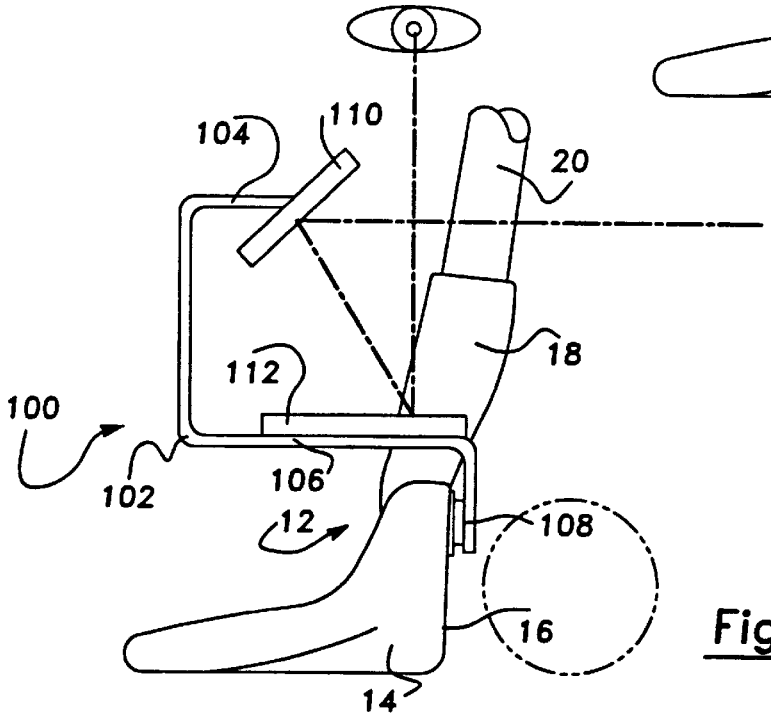
FIG. 9 is an end view of the golf club of FIG. 1 having yet still another embodiment of the training and aligning accessory of the present invention attached thereto.

Accordingly, a compound mirror accessory, generally illustrated as 100, is shown in FIG. 9. The accessory 100 includes a bracket 102 that includes a primary mirror mount 104, a secondary mirror mount 106, and a pair of spaced apart tabs 108 (of which only one is shown). A primary mirror 110 is attached to the primary mirror mount 104 and a secondary mirror 112 is attached to the secondary mirror mount 106. The primary mirror 110 receives the image of the target (not shown) and the secondary mirror 112 reflects the image for viewing by the golfer.

The accessories 10, 60, 70, 80 and 100 shown in the various figures and discussed above in the specification demonstrate various approaches to solving the problems associated with known golf training and aligning devices. While the methods of attaching the accessories differ among these accessories, each still relies upon an angled mirror to view the flagpole in the cup. It may be desired to assess the accuracy of the alignment of the golf club face by means other than a reflected, natural light image. The present invention provides a form of alignment which supplements the natural light image approach.

Figure 10:
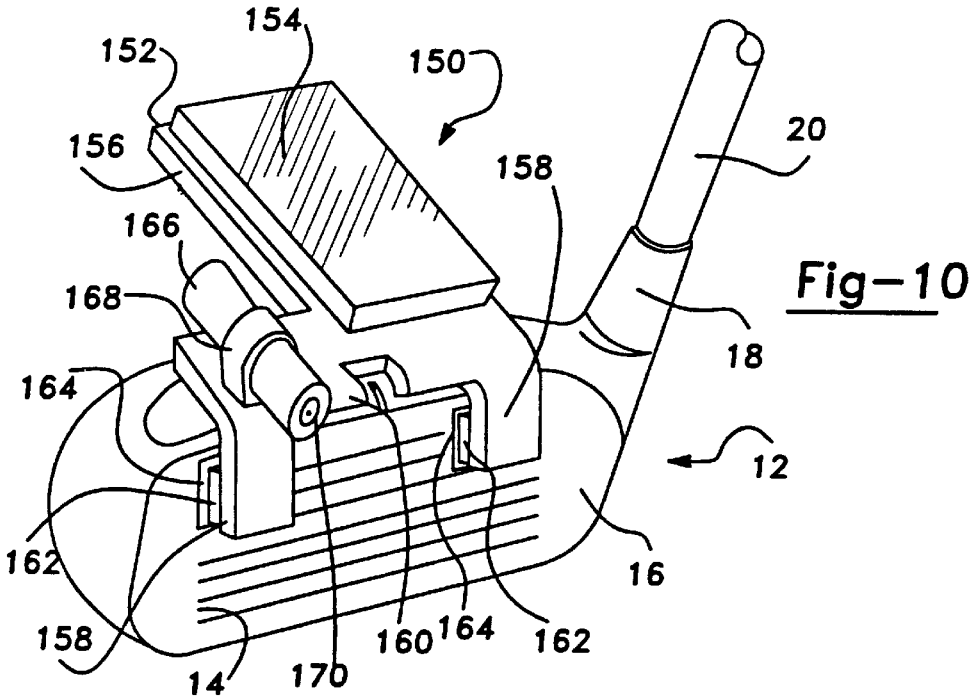
FIG. 10 is a perspective view of yet another alternate embodiment of the device of the present invention attached to a golf club head.

Specifically, and with respect to FIG. 10, an alternate approach to visualizing the flagpole is illustrated. An accessory, generally illustrated as 150, includes a bracket 152 and a mirror 154. The bracket 152 includes a mirror support 156 and a pair of spaced apart tabs 158. A notch 160 is formed on the bracket 152 and is similar if not the same in form and function to the notch 34 shown in FIGS. 1 and 6 and described in conjunction therewith. The tabs 158 are attached to the golf club face 16 by one of the methods described above. As illustrated, a pair of magnets 162 are releasably attached to a pair of mounting plates 164. The mounting plates 164 are themselves attached to the golf club face 16 by adhesive tape or by adhesive cement.

Also mounted on the bracket 152 is a laser projection unit 166. The laser projection unit 166 is of the battery operated type and may be rechargeable. The laser projection unit 166 includes a mounting strap 168 for attachment to the bracket 152, although other methods of attachment may be used. The laser projection unit 166 also includes a laser light opening 170 formed at its front end.

In operation, the user (not shown) addresses the ball and observes the image of the flagpole (not shown) for viewing the reflected red glow of the laser light on the user-facing side of the pole. When the glow appears on the flagpole as observed in the mirror, the club face is in alignment. As may be understood, limitations exist such that the distance that the laser light can travel is limited particularly in natural ambient light. Accordingly, this laser projection unit 166 of the accessory 150 may only be suitable for close approaches to the flagpole. However, even in these circumstances, the user may still rely upon the mirror 154 alone according to techniques described above.

As golfers know, quality golf clubs for every purpose are quite expensive. Where the golf club head is composed of a non-ferrous material, it may be that the golfer does not want to compromise the value of a particular golf club by the permanent or semi-permanent adhesion of the mounting plates shown in the various figures to the golf club face. Accordingly, an alternate method of attaching the accessory of the present invention is shown in FIG. 11 which avoids physical attachment of the aligning tab to the golf club face.

Figure 11:
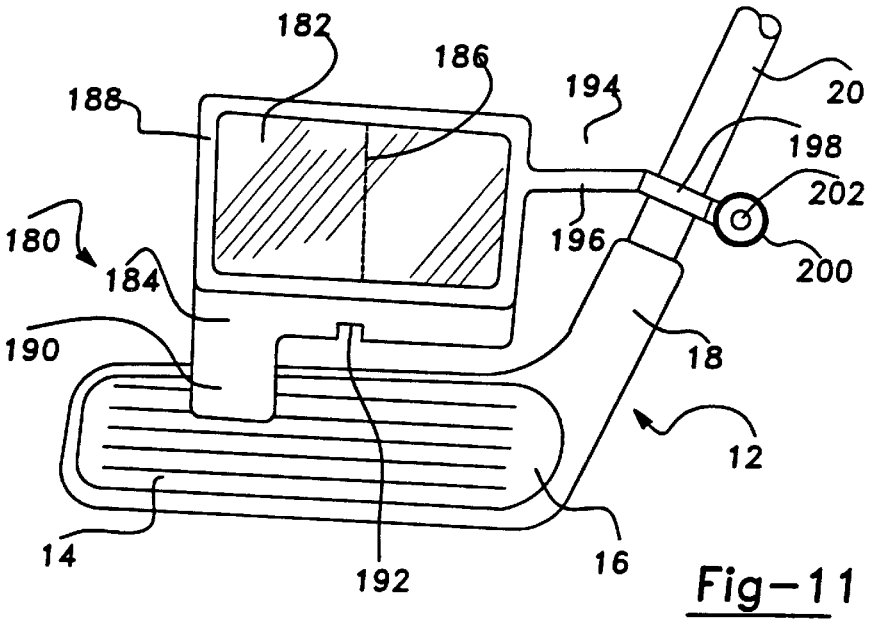
FIG. 11 is a side view of still another alternate embodiment of the device of the present invention attached to a golf club head.

Accordingly, and with respect to FIG. 11, a golf club training and aligning accessory is shown, generally illustrated as 180. The accessory 180 includes a mirror 182 and a bracket 184. As with the bracket 24 described above, the bracket 184 may be composed of a metal (stamped, molded, or wire form) or of a plastic. The mirror 182 is attached to the bracket 184 and includes a centerline 186. The bracket 184 includes a mirror mounting portion 188 and a golf club face contacting and aligning tab 190. The tab 190 is rested against the face of the club to assure that the accessory 180 is properly aligned therewith. A notch 192 is also formed in the bracket 184 to verify that the accessory 180 is properly aligned with the club head 14 and the user's eyes are in proper perpendicular alignment to the mirror 182, as discussed above in relation to other embodiments of the present invention.

The accessory 180 also includes a golf club attachment portion, generally illustrated as 194. The attachment portion 194 includes a support arm 196 and an attachment collar 198. The collar 198 is positioned substantially around the outer diameter of a portion of the club shaft 20. A mechanical fastener such as a knurled knob 200 is fitted to the attachment collar 198 and is selectively threaded to a bolt 202.

In operation, the user loosens the knurled knob 200, removes the knob 200 from the bolt 202, removes the bolt 202 from the collar 198, and separates the spaced apart ends of the collar (not shown). With the collar 198 open, the user next positions the collar 198 on the golf club shaft 20. The bolt 202 is returned to its retaining position and the knurled knob 200 is threaded onto the threaded portion of the bolt 202. The user verifies that the tab 190 is flush with the golf club face 16 and turns down the knurled knob 200 until the collar 198 is secured to the shaft 20. Because of the described mechanical attachment of the accessory 180 to the golf club 12, the accessory 180 is perhaps better suited for use with woods or irons and may, in fact, be left attached to any of these clubs throughout play.

Having described my invention, many modifications thereto will become apparent to those skilled in the art to which it pertains without deviation from the spirit of the invention as defined by the scope of the appended claims.

I claim:

1. An accessory for a golf club for use by a golfer, the golf club having a shaft and a head connected to the shaft, the head including a face and a top side, the top side having an alignment mark formed thereon, the accessory comprising:

a body;

a pair of cantilevered tabs attached to said body and extending therefrom, said body defining a first plane and said tabs defining a second plane, said first and second planes being different and being angled with respect to each other, each of said cantilevered tabs including a portion that is releasably positionable against the face of the head of the golf club;

a notch formed in said body at a position generally between said pair of tabs, said notch being configured and positioned so as to allow visualization of the alignment mark on the golf club head when the golf club is held by the golfer;

attachment means adapted to be fitted to the face of the head of the gold club for releasable attachment of said releasably positionable portion of said cantilevered tabs; and aligning means operatively associated with said body for aligning the golf club head with respect to an object substantially in front of the golf club face, said means for aligning the golf club with respect to an object comprising a reflective surface.

2. The accessory for a golf club of claim 1, wherein said reflective surface comprises two or more reflective surfaces.

3. The accessory for a golf club of claim 1, wherein said reflective surface includes a middle portion, said middle portion having a centerline formed thereon.

4. The accessory for a golf club of claim 1, further including an attachment element associated with said cantilevered tabs.

5. The accessory for a golf club of claim 4, wherein said attachment element includes a magnet fitted to said cantilevered tabs.

6. The accessory for a golf club of claim 5, wherein said attachment means fitted to said golf club face further includes a metallic element fitted on the golf club face for magnetic attachment of the accessory thereto.

7. The accessory for a golf club of claim 4, wherein said attachment means fitted to said golf club face comprises a slot attached to the golf club face for removably receiving said cantilevered tabs.

8. The accessory for a golf club of claim 4, wherein said attachment element comprises a suction cup fitted to said cantilevered tabs.

9. The accessory for a golf club of claim 4, wherein said attachment element comprises a collar attachable to the golf club shaft.

10. The accessory for a golf club of claim 1, wherein said means for aligning the golf club with respect to an object includes a laser light attached to said body.

11. The accessory for a golf club of claim 1, wherein said cantilevered tabs is hingedly fitted to said attaching and aligning assembly.

12. An accessory for attachment to a golf club for use by a golfer, the golf club having a shaft and a head connected to the shaft, the head including a face and a top side, the top side having an alignment mark formed thereon, the accessory comprising:

a bracket, said bracket defining a substantially planar element lying in a first plane, said bracket having a top side and a lower end;

a pair of spaced apart club-face attachment tabs associated with said lower end of said bracket, said tabs lying in a second plane, said second plane being positioned at about a 45° angle with respect to said first plane;

a notch formed in said lower end of said bracket generally between said spaced apart club-face attachment tabs, said notch to be formed in a position in between the alignment mark of the top side of the head of the golf club and the eyes of the golfer so as to keep an unobstructed line of sight therebetween; and a reflective surface operatively associated with said top side of said bracket.

13. The accessory of claim 12, further including means for attachment operatively associated with said tabs of said bracket, said means for attachment including an element fitted to the face of the golf club head for attachment of said tabs thereto.

14. The accessory of claim 13, wherein said means for attachment includes a magnet fitted to each of said pair of tabs.

15. The accessory of claim 14, wherein said element fitted to the face of the golf club is a metallic plate for magnetic attachment of said magnet thereto.

16. The accessory of claim 13, wherein said element fitted to the face of the golf club is a U-shaped bracket for insertion of one of said pair of tabs.

17. The accessory of claim 13, wherein said element fitted on the face of the golf club is an adhesive element for adhesion of said tabs thereto.

18. The accessory of claim 12, wherein said means for attaching the accessory further includes an attachment arm extending from said bracket, said arm including means for attaching said arm to the golf club shaft.

19. The accessory of claim 18, wherein said means for attaching said arm includes a collar fitted to said attachment arm, said collar being attachable to the golf club shaft.

20. The accessory of claim 12, further including a laser light unit attached to said bracket.

21. A combination golf club and aligning tool, the combination comprising:

a golf club head having a face and a top side, said top side including an alignment mark formed thereon;

an aligning tool including a mirror support and a pair of spaced apart club-face attachment tabs extending at an angle from said mirror support, said mirror support having a top side and a bottom side, said bottom side being positioned to substantially face said top side of said golf club head;

a mirror element mounted on said mirror support;

a notch formed in said mirror support, said notch being defined by a pair of opposing walls, said notch being formed substantially between said attachment tabs, said notch being adjacent said alignment mark of said golf club head such that said alignment mark may be visualized between said pair of opposing walls; and means for releasably attaching said attachment tabs to said club face.

* * * * *